US011370090B2

(12) United States Patent
Ge

(10) Patent No.: US 11,370,090 B2
(45) Date of Patent: Jun. 28, 2022

(54) TWO-WAY RATCHET SCREWDRIVER

(71) Applicant: NINGBO HONY PLASTIC TECHNOLOGY CO., LTD, Zhejiang (CN)

(72) Inventor: Wenbing Ge, Zhejiang (CN)

(73) Assignee: NINGBO HONY PLASTIC TECHNOLOGY CO., LTD, Ningbo (CN)

( * ) Notice: Subject to any disclaimer, the term of this patent is extended or adjusted under 35 U.S.C. 154(b) by 300 days.

(21) Appl. No.: 16/718,110

(22) Filed: Dec. 17, 2019

(65) Prior Publication Data

US 2021/0154805 A1 May 27, 2021

(30) Foreign Application Priority Data

Nov. 21, 2019 (CN) ..... 201911148254.7

(51) Int. Cl.
*B25B 15/04* (2006.01)
*B25B 23/16* (2006.01)

(52) U.S. Cl.
CPC ..... *B25B 15/04* (2013.01); *B25B 23/16* (2013.01)

(58) Field of Classification Search
CPC ..... B25B 15/04; B25B 23/16
USPC ..... 81/63.1
See application file for complete search history.

(56) References Cited

U.S. PATENT DOCUMENTS 8,707,831 B2 * 4/2014 Palmer ..... B25B 13/467 81/57.29
9,572,616 B2 * 2/2017 Vaughn ..... A61B 17/8875

FOREIGN PATENT DOCUMENTS

EP 2946885 A4 * 5/2017 ..... B25B 17/00

* cited by examiner

*Primary Examiner* — Hadi Shakeri

(57) ABSTRACT

A two-way ratchet screwdriver includes a handle, a main shaft acting on a working end, a ratchet seat, and a reversing seat. Two ends of the ratchet seat are provided with an upper ratchet head and a lower ratchet head, respectively. The upper ratchet head has the same structure as the lower ratchet head and is fixedly connected to the handle. The upper ratchet head is provided with a circle of wheel facing teeth and a circle of ratchet teeth. The wheel facing teeth of the upper and lower ratchet heads are connected by pinions. A periphery of the reversing seat is mounted with at least one set of a forward pawl and an inverse pawl passing through the ratchet seat. The reversing seat is switched to rotate to drive the forward pawl or inverse pawl to act on the ratchet teeth of the upper and lower ratchet heads.

9 Claims, 3 Drawing Sheets

TWO-WAY RATCHET SCREWDRIVER

CROSS REFERENCE TO RELATED APPLICATIONS

The present application claims the benefit of Chinese Patent Application No. 201911148254.7 filed on Nov. 21, 2019, the contents of which are incorporated herein by reference in their entirety.

FIELD OF THE INVENTION

The present disclosure relates to a screwdriver, and particularly to a two-way ratchet screwdriver.

BACKGROUND OF THE INVENTION

In the existing art, as a tool for fastening and screwing screws, a screwdriver for mounting and removing screws is generally of a hand-screw type. Since the rotation of hand is limited to some extent and the hand cannot always rotate in one direction, when using this type of tool, generally the hand rotates a tool handle in a desired direction, and then the hand rotates in an opposite direction and then repositions the tool to enter the next working cycle. The inverse rotation of the hand involves releasing the tool handle and then holding it again such that the main shaft does not move when the handle is inversed, or separating the hand tool from the screw and re-inserting the screw for rotation, which makes the entire rotation inconvenient.

Therefore, in current practice, the tool is equipped with a one-way device such as a ratchet mechanism so as to become a ratchet screwdriver. With such structure, the user's hand does not need to be separated from the handle of the screwdriver, and it is not necessary to re-insert the screw for rotation after separating the screwdriver from the screw. However, in the existing art, ratchet screwdrivers generally adopt a one-way transmission structure of the ratchet, and such ratchet screwdriver can only fasten screws in a single direction, being unable to fasten in the inverse direction.

The present disclosure relates to "a two-way ratchet screwdriver", which can achieve the rotation of screws in different directions so as to achieve a collection of functions.

SUMMARY OF THE INVENTION

The technical problem to be solved by the present disclosure is to provide a two-way ratchet screwdriver, which is designed with a new structure to achieve a two-way operation of the screwdriver.

The technical solution adopted by the present disclosure to solve the above technical problem is a two-way ratchet screwdriver, including a handle, a main shaft acting on a working end, a ratchet seat, and a reversing seat. The ratchet seat is sleeved outside the main shaft so as to drive the main shaft to rotate synchronously. Two ends of the ratchet seat are provided with an upper ratchet head and a lower ratchet head, respectively. The upper ratchet head has the same structure as the lower ratchet head and is fixedly connected to the handle. The upper ratchet head is provided with a circle of wheel facing teeth and a circle of ratchet teeth. The wheel facing teeth of the upper ratchet head and the wheel facing teeth of the lower ratchet head are connected by means of pinions. The rotation of the upper ratchet head drives the lower ratchet head to rotate in an opposite direction. A periphery of the reversing seat is mounted with at least one set of a forward pawl and an inverse pawl passing through the ratchet seat. The reversing seat can be switched to rotate so as to drive the forward pawl or inverse pawl to act on the ratchet teeth of the upper ratchet head and the lower ratchet head. The upper ratchet head only drives the forward pawl to rotate forward or the inverse pawl to rotate inversely, and the lower ratchet head drives the forward pawl to rotate inversely or the inverse pawl to rotate forward. The rotating forward pawl and inverse pawl drive the main shaft to rotate by means of the ratchet seat.

In a further preferred solution of the present disclosure, the reversing seat is sleeved outside the main shaft, and the main shaft is able to rotate freely in the reversing seat. The reversing seat is connected to a reversing button, and switching the reversing button will drive the reversing seat to rotate forward or inversely.

In a further preferred solution of the present disclosure, a surface of the reversing seat is provided with a forward notch and an inverse notch, each having a parallelogram structure, and a wall surface of an end of the forward notch and a wall surface of an end of the inverse notch are inclined surfaces which have opposite inclined directions.

A surface of the ratchet seat is provided with a channel in an axial direction, and the forward pawl and the inverse pawl pass through the channel and can only move along the channel. The rotation of the reversing seat will drive the forward pawl and the inverse pawl to move axially along the channel.

In a further preferred solution of the present disclosure, the forward pawl and the inverse pawl each form a narrow parallelogram structure, and an end of the forward pawl and an end of the inverse pawl are inclined surfaces which have opposite inclined directions.

In a further preferred solution of the present disclosure, the forward pawl is mounted to the forward notch, and the inverse pawl is mounted to the inverse notch. The end of the forward pawl is inclined in the same direction as the wall surface of the end of the forward notch, and the end of the inverse pawl is inclined in the same direction as of the wall surface of the end of the inverse notch.

In a further preferred solution of the present disclosure, the forward pawl and the inverse pawl are both formed by two paw pieces connected by means of a spring. Each of the paw pieces is provided with a protrusion on the inner side thereof, and each of the paw pieces is mounted to the forward notch or the inverse notch by means of the protrusion. The spring is in a compressed state, and the spring drives the protrusion to closely attach to the wall surface of the end of the forward notch or inverse notch.

In a further preferred solution of the present disclosure, a gear seat is sleeved outside a middle portion of the ratchet seat, and pinions are mounted on both sides of the gear seat. The pinions are arranged perpendicular to the upper ratchet head and the lower ratchet head, and the pinions are connected to the upper ratchet head and the lower ratchet head.

In a further preferred solution of the present disclosure, the upper ratchet head has a cylindrical structure. An outer end surface of the upper ratchet head is provided with a circle of wheel facing teeth, and an inner bottom surface of the upper ratchet head is provided with a circle of ratchet teeth.

In a further preferred solution of the present disclosure, a grip is sleeved outside the gear seat, the handle is located on one side of the grip, and the reversing button is located on the other side of the grip.

In comparison with the existing art, the advantages of the present disclosure lie in that the upper ratchet head and the lower ratchet head are firstly connected by means of the pinions, such that the upper ratchet head and the lower ratchet head can rotate in opposite directions; by setting the forward pawl and the inverse pawl which cooperate with the ratchet teeth of the upper ratchet head and lower ratchet head, the ratchet effect of the upper ratchet head and lower ratchet head is achieved, that is, whether the handle is rotated forward or inversely, the main shaft is rotated in the same direction. Further, in order to achieve the switchable rotation direction of the main shaft, the present disclosure provides a reversing seat, and the switch of the reversing seat can drive the forward pawl and the inverse pawl to move so as to switch the engaged ratchet teeth, thereby changing the ratchet effect of the upper ratchet head and lower ratchet head, such that the ratchet directions of the upper ratchet head and lower ratchet head are exchanged. In summary, the structural design of the present disclosure can realize a two-way operation of the screwdriver.

BRIEF DESCRIPTION OF THE DRAWINGS

The present disclosure will be further described in detail below with reference to the accompanying drawings and preferred embodiments. However, those skilled in the art will appreciate that these drawings are drawn only for the purpose of explaining the preferred embodiments and therefore should not be taken as limiting the scope of the present disclosure. In addition, unless specifically stated, the drawings are only schematic to represent the components or construction of the described objects conceptually and may be presented in an exaggerated manner, and the drawings are not necessarily drawn to scale.

DETAILED DESCRIPTION OF THE EMBODIMENTS

The present disclosure will be described in detail below with reference to the accompanying drawings.

The present disclosure is further described in detail below with reference to the accompanying drawings and embodiments such that the objectives, technical solutions, and advantages of the present disclosure are clearer. It should be understood that the specific embodiments described herein are merely for explaining the present disclosure and are not intended to limit the present disclosure.

Figure 1:
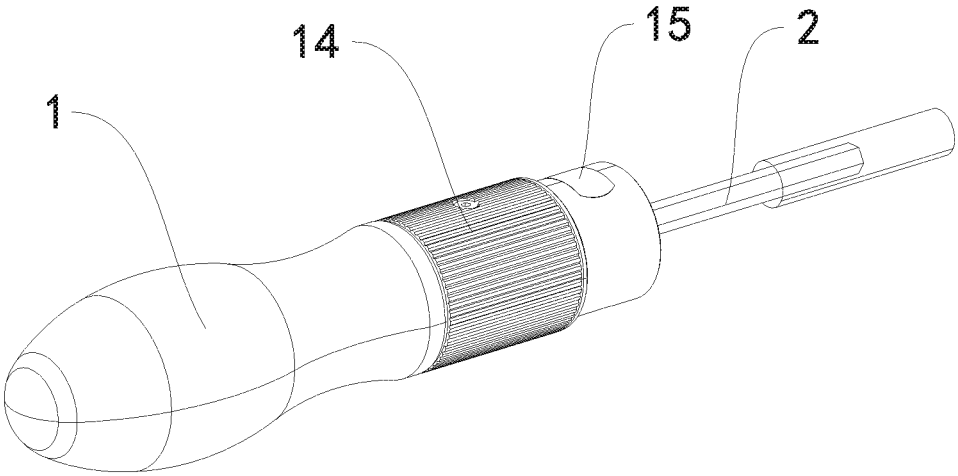
FIG. 1 is a structural schematic diagram of the present disclosure.
Figure 2:
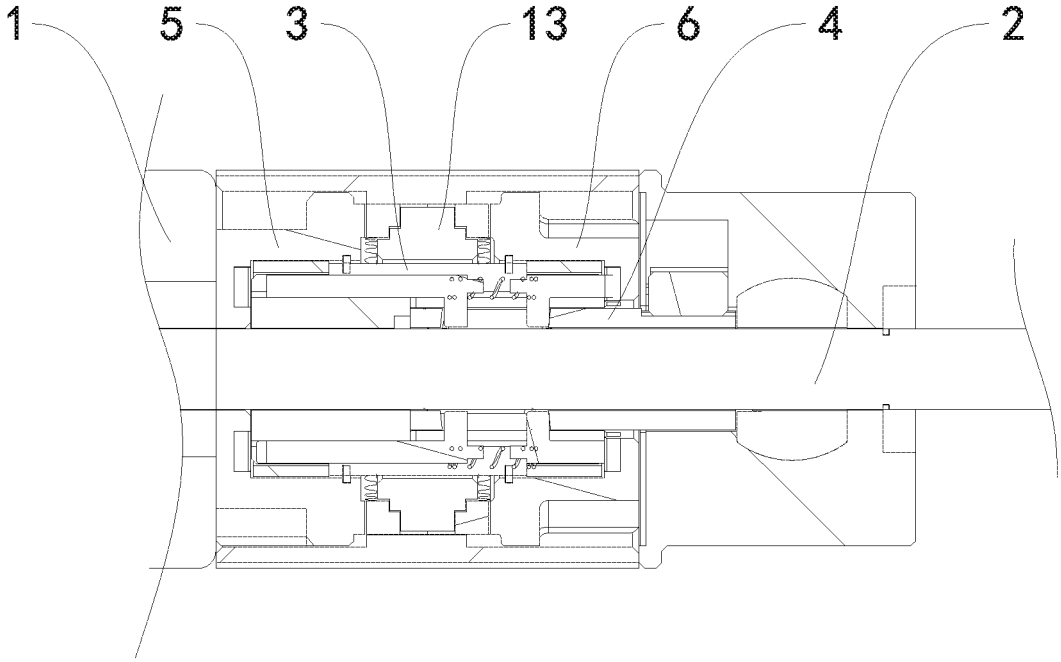
FIG. 2 is an exploded structural schematic diagram of the present disclosure.
Figure 3:
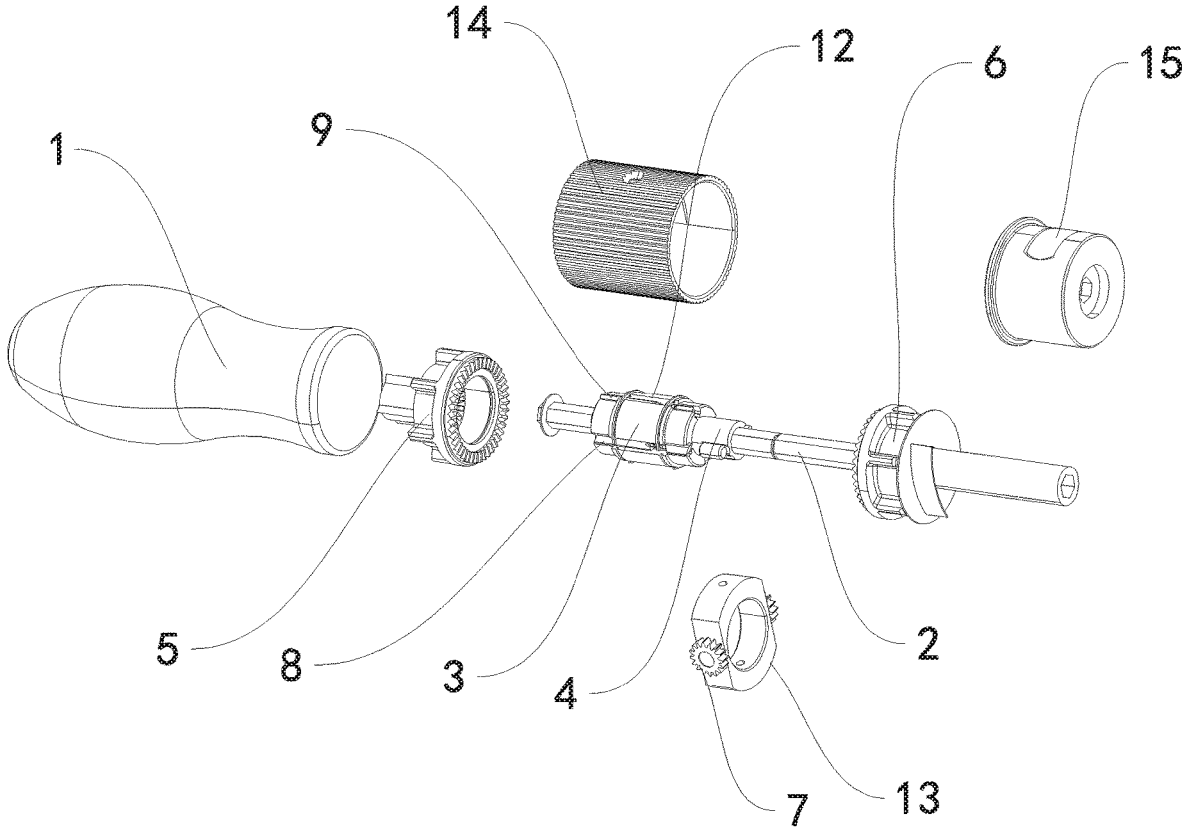
FIG. 3 is a sectional diagram of the present disclosure.
Figure 4:
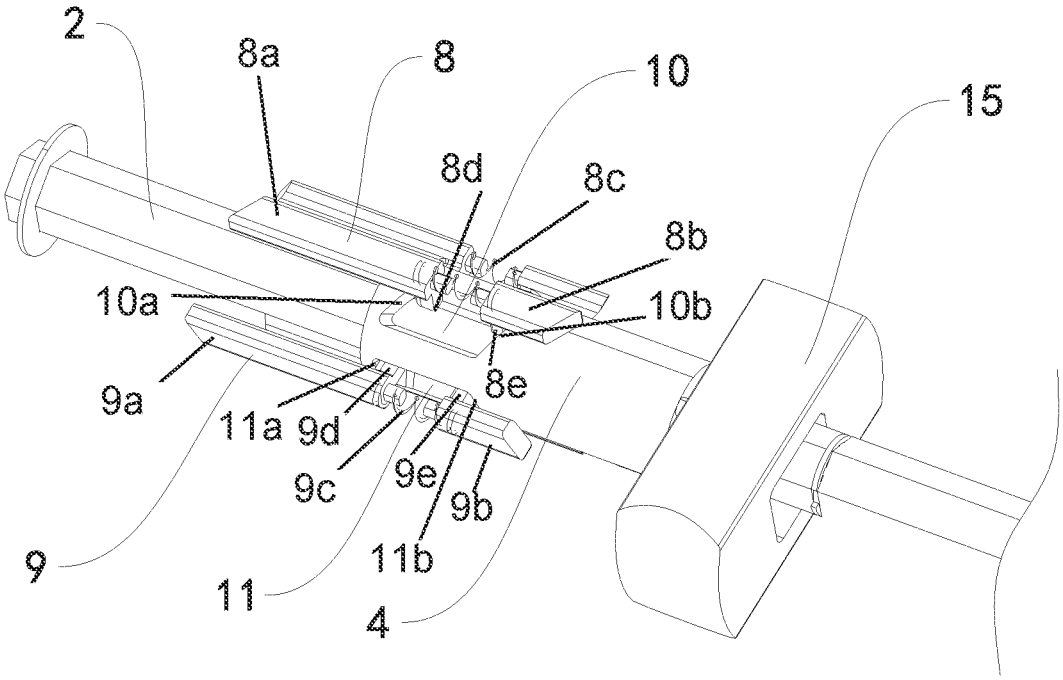
FIG. 4 is an inner structural schematic diagram of the present disclosure.
Figure 5:
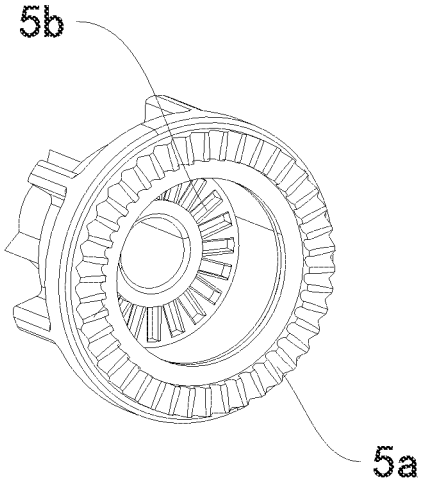
FIG. 5 is a structural schematic diagram of an upper ratchet head of the present disclosure.

As shown in FIGS. 1-5, a two-way ratchet screwdriver includes a handle 1, a main shaft 2 acting on a working end, a ratchet seat 3, and a reversing seat 4. The ratchet seat 3 is sleeved outside the main shaft 2 so as to drive the main shaft 2 to rotate synchronously. Two ends of the ratchet seat 3 are provided with an upper ratchet head 5 and a lower ratchet head 6, respectively. The upper ratchet head 5 has the same structure as the lower ratchet head 6 and is fixedly connected to the handle 1. The upper ratchet head 5 is provided with a circle of wheel facing teeth 5*a* and a circle of ratchet teeth 5*b*. The wheel facing teeth 5*a* of the upper ratchet head 5 and the wheel facing teeth 5*a* of the lower ratchet head 6 are connected by means of pinions 7. The rotation of the upper ratchet head 5 drives the lower ratchet head 6 to rotate in an opposite direction. At least one set of a forward pawl 8 and an inverse pawl 9 passing through the ratchet seat 3 is mounted on a periphery of the reversing seat 4. The reversing seat 4 may be switched to rotate so as to drive the forward pawl 8 or inverse pawl 9 to act on the ratchet teeth 5*b* of the upper ratchet head 5 and the lower ratchet head 6. The upper ratchet head 5 only drives the forward pawl 8 to rotate forward or the inverse pawl 9 to rotate inversely, and the lower ratchet head 6 drives the forward pawl 8 to rotate inversely or the inverse pawl 9 to rotate forward. The rotating forward pawl 8 and inverse pawl 9 drive the main shaft 2 to rotate by means of the ratchet seat 3. It should be noted that in the present disclosure, when viewed from the working end toward the handle 1, clockwise rotation of the handle 1 is determined as the forward rotation, and counterclockwise rotation of the handle 1 is determined as the inverse rotation. Further, the forward pawl 8 and the inverse pawl 9 as well as the forward notch 10 and the inverse notch 11 herein are only for distinguishing different components and do not have specific meanings.

The reversing seat 4 is sleeved outside the main shaft 2, and the main shaft 2 is able to rotate freely within the reversing seat 4. The reversing seat 4 is connected to a reversing button 15, and switching the reversing button 15 will drive the reversing seat 4 to rotate forward or inversely.

A surface of the reversing seat 4 is provided with a forward notch 10 and an inverse notch 11, each having a parallelogram structure, and a wall surface (10*a*, 10*b*) of an end of the forward notch 10 and a wall surface (11*a*, 11*b*) of an end of the inverse notch 11 are inclined surfaces which have opposite inclined directions. In the present disclosure, the structural design of the forward notch 10 and the inverse notch 11 determines that when the forward pawl 8 is engaged with the upper ratchet head 5, the forward pawl 8 definitely is separated from the lower ratchet head 6, and vice versa. Further, when the inverse ratchet pawl is engaged with the upper ratchet head 5, the inverse pawl 9 definitely is separated from the lower ratchet head 6, and vice versa. In other words, either the forward pawl 8 or the inverse pawl 9 may only be engaged with one of the upper ratchet head 5 and the lower ratchet head 6.

Further, when the forward pawl 8 is engaged with the upper ratchet head 5, the inverse pawl 9 is engaged with the lower ratchet head 6 as well. At this time, when the handle 1 is rotated forward (i.e., the upper ratchet head 5 is rotated forward), the upper ratchet head 5 drives the forward pawl 8 to rotate forward, and the lower ratchet head 6 is rotated inversely at this time. However, the inversely rotated lower ratchet head 6 is unable to drive the inverse pawl 9 to rotate inversely, and at this time, the lower ratchet head 6 is in an idling state (which is resulted from the structure of the inverse pawl 9, i.e., the end of the inverse pawl 9 being an inclined surface as described later). When the handle 1 is rotated inversely (i.e., the upper ratchet head 5 is rotated inversely), the upper ratchet head 5 is idling (which is resulted from the structure of the forward pawl 8, i.e., the end of the forward pawl 8 being an inclined surface as described later). At this time, the lower ratchet head 6 is rotated forward, and the forward rotated ratchet head drives the inverse pawl 9 to rotate forward. The present disclosure hereto achieves the forward rotation or inverse rotation of the handle 1 as well as the forward rotation of the reversing seat 4, thereby driving the main shaft 2 to rotate forward.

When the inverse pawl 9 is engaged with the upper ratchet head 5, the forward pawl 8 is engaged with the lower ratchet head 6 as well. At this time, when the handle 1 is rotated forward (i.e., the upper ratchet head 5 is rotated forward), the upper ratchet head 5 is idling. At this time, the lower ratchet head 6 is rotated inversely, and the inversely rotated ratchet head drives the forward pawl 8 to rotate inversely. When the handle 1 is rotated inversely (i.e., the upper ratchet head 5 is rotated inversely), the upper ratchet head 5 drives the inverse pawl 9 to rotate inversely. At this time, the lower ratchet head 6 is rotated forward and is unable to drive the forward pawl 8 to rotate, and the lower ratchet head 6 is idling. The present disclosure hereto achieves the forward rotation or inverse rotation of the handle 1 as well as the inverse rotation of the reversing seat 4, thereby driving the main shaft 2 to rotate inversely.

A surface of the ratchet seat 3 is provided with a channel 12 in an axial direction, and the forward pawl 8 and the inverse pawl 9 pass through the channel 12 and can only move along the channel 12. The rotation of the reversing seat 4 will drive the forward pawl 8 and the inverse pawl 9 to move axially along the channel 12.

The forward pawl 8 and the inverse pawl 9 each form a narrow parallelogram structure, and the end of the forward pawl 8 and the end of the inverse pawl 9 are inclined surfaces which have opposite inclined directions. The structure configuration of the forward pawl 8 and the inverse pawl 9 cooperates with the ratchet teeth 5*b* of the upper ratchet head 5 and the lower ratchet head 6 to achieve the ratchet effect of the present disclosure.

The forward pawl 8 is mounted to the forward notch 10, and the inverse pawl 9 is mounted to the inverse notch 11. The end of the forward pawl 8 is inclined in the same direction as the wall surface of the end of the forward notch 10, and the end of the inverse pawl 9 is inclined in the same direction as the wall surface of the end of the inverse notch 11. In other words, when the reversing seat 4 is rotated, the forward pawl 8 and the inverse pawl 9 will move in opposite directions.

The forward pawl 8 and the inverse pawl 9 are both formed by two paw pieces (8*a*, 8*b*, 9*a*, 9*b*) connected by means of a spring (8*c*, 9*c*). Each of the paw pieces (8*a*, 8*b*, 9*a*, 9*b*) is provided with a protrusion (8*d*, 8*e*, 9*d*, 9*e*) on an inner side thereof, and each of the paw pieces (8*a*, 8*b*, 9*a*, 9*b*) is mounted to the forward notch 10 or the inverse notch 11 by means of the protrusion (8*d*, 8*e*, 9*d*, 9*e*). The spring (8*c*, 9*c*) is in a compressed state, and the spring (8*c*, 9*c*) drives the protrusion (8*d*, 8*e*, 9*d*, 9*e*) to closely attach to the wall surface of the end of the forward notch 10 or inverse notch 11. In this way, it can be ensured that the forward pawl 8 and inverse pawl 9 are moved into position.

A gear seat 13 is sleeved outside a middle portion of the ratchet seat 3, and pinions 7 are mounted on both sides of the gear seat 13. The pinions are arranged perpendicular to the upper ratchet head 5 and the lower ratchet head 6, and the pinions 7 are connected to the upper ratchet head 5 and the lower ratchet head 6. With the pinions 7, synchronous rotation of the upper ratchet head 5 and the lower ratchet head 6 are achieved and the rotation directions thereof are opposite.

The upper ratchet head 5 has a cylindrical structure. An outer end surface of the upper ratchet head 5 is provided with a circle of wheel facing teeth 5*a*, and an inner bottom surface of the upper ratchet head 5 is provided with a circle of ratchet teeth 5*b*.

A grip 14 is sleeved outside the gear seat 13, the handle 1 is located on one side of the grip 14, and the reversing button is located on the other side of the grip 14.

In the present disclosure, when the screwdriver is used, firstly, a working direction is selected using the reversing button, for example, forward rotation of the working end is selected. With holding the grip 14 in one hand and rotating the handle 1 in the other, the handle 1 is rotated forward (rotated clockwise), since the forward pawl 8 is engaged with the ratchet teeth 5*b* of the upper ratchet head 5, and the upper ratchet head 5 will drive the forward pawl 8 and the ratchet seat 3 to rotate, the main shaft 2 and the handle 1 are rotated forward, such that the working end is rotated clockwise. The handle 1 is rotated inversely (rotated counterclockwise), and the upper ratchet head 5 and the forward pawl 8 are in an idling state due to the ratchet function. At this time, the lower ratchet head 6 is rotated forward (rotated clockwise). Since the inverse pawl 9 is engaged with the lower ratchet head 6, the ratchet seat 3 is driven to rotate forward, thereby causing the working end to rotate clockwise. Similarly, when inverse rotation of the working end is selected by the reversing button, regardless of whether the handle 1 is rotated forward or inversely, the main shaft 2 acting on the working end is rotated counterclockwise.

Therefore, according to the present disclosure, when the handle 1 swings back and forth clockwise and counterclockwise, the working end moves in the same direction, greatly improving working efficiency.

In the description of the present disclosure, it should be noted that the orientations or positional relationships indicated by terms "center", "upper", "lower", "left", "right", "vertical", "horizontal", "inner", "outer", etc. are based on the orientations or position relationships shown in the drawings. These terms are only for the convenience of describing the present disclosure and simplifying the description, and do not indicate or imply that the device or element referred to must have a specific orientation and be constructed and operated in a specific orientation, and therefore cannot be understood as limiting the present disclosure. In addition, terms "first", "second", and "third" are only for purposes of description and should not be interpreted as indicating or implying relative importance.

In the description of the present disclosure, it should be noted that unless explicitly indicated and specified otherwise, terms "mounted", "connected to", and "connected" should be interpreted broadly. For example, it may be a fixed connection, a detachable connection, or an integral connection; it may be a mechanical connection or an electrical connection; it may be a direct connection, or an indirect connection by means of an intermediary, or it may be a communication internal of two elements. For those of ordinary skill in the art, the specific meanings of the above terms in the present disclosure may be understood according to specific situations.

The present disclosure has been described in detail above. Specific examples are used herein to explain the principle and implementation of the present disclosure. The description of the above embodiments is only for understanding the present disclosure and the core idea. It should be noted that for those of ordinary skill in the art, several improvements and modifications can be made to the present disclosure without departing from the principle of the present disclosure, and these improvements and modifications also fall within the protection scope of the claims of the present disclosure.

What is claimed is:

1. A two-way ratchet screwdriver, comprising: a handle, a main shaft acting on a working end, a ratchet seat, and a reversing seat, wherein the ratchet seat is sleeved outside the main shaft so as to drive the main shaft to rotate synchronously; two ends of the ratchet seat are provided with an upper ratchet head and a lower ratchet head, respectively, and the upper ratchet head has a same structure as the lower ratchet head and is fixedly connected to the handle; the upper ratchet head is provided with a circle of wheel facing teeth and a circle of ratchet teeth; the wheel facing teeth of the upper ratchet head and wheel facing teeth of the lower ratchet head are connected by means of pinions; the rotation of the upper ratchet head drives the lower ratchet head to rotate in an opposite direction; a periphery of the reversing seat is mounted with at least one set of a forward pawl and an inverse pawl passing through the ratchet seat; the reversing seat is rotatable so as to drive the forward pawl or inverse pawl to act on the ratchet teeth of the upper ratchet head and the lower ratchet head; the upper ratchet head only drives the forward pawl to rotate forward or the inverse pawl to rotate inversely, and the lower ratchet head drives the forward pawl to rotate inversely or the inverse pawl to rotate forward; and the rotating forward pawl and inverse pawl drive the main shaft to rotate by means of the ratchet seat;

wherein, a surface of the reversing seat is provided with a forward notch and an inverse notch, each having a parallelogram structure, wherein a wall surface of an end of the forward notch and a wall surface of an end of the inverse notch are inclined surfaces which have opposite inclined directions.

2. A two-way ratchet screwdriver according to claim 1, wherein, the reversing seat is sleeved outside the main shaft, and the main shaft is able to rotate freely in the reversing seat, wherein a reversing button is connected to the reversing seat and configured to drive the reversing seat to rotate forward or inversely.

3. A two-way ratchet screwdriver according to claim 2, wherein, a gear seat is sleeved outside a middle portion of the ratchet seat, and pinions are mounted on both sides of the gear seat, wherein the pinions are arranged perpendicular to the upper ratchet head and the lower ratchet head, and the pinions are connected to the upper ratchet head and the lower ratchet head.

4. A two-way ratchet screwdriver according to claim 3, wherein a grip is sleeved outside the gear seat, the handle is located on one side of the grip, and the reversing button is located on an other side of the grip.

5. A two-way ratchet screwdriver according to claim 1, wherein, a surface of the ratchet seat is provided with a channel in an axial direction, and the forward pawl and the inverse pawl pass through the channel and are only movable along the channel, wherein the rotation of the reversing seat will drive the forward pawl and the inverse pawl to move axially along the channel.

6. A two-way ratchet screwdriver according to claim 1, wherein, the forward pawl and the inverse pawl each form a narrow parallelogram structure, wherein an end of the forward pawl and an end of the inverse pawl are inclined surfaces which have opposite inclined directions.

7. A two-way ratchet screwdriver according to claim 6, wherein, the forward pawl is mounted to the forward notch, and the inverse pawl is mounted to the inverse notch, wherein the end of the forward pawl is inclined in the same direction as the wall surface of the end of the forward notch, and the end of the inverse pawl is inclined in the same direction as of the wall surface of the end of the inverse notch.

8. A two-way ratchet screwdriver according to claim 1, wherein, the forward pawl and the inverse pawl are both formed by two paw pieces connected by means of a spring, wherein each of the paw pieces is provided with a protrusion on an inner side thereof; each of the paw pieces is mounted to the forward notch or the inverse notch by means of the protrusion; the spring is in a compressed state; and the spring drives the protrusion to closely attach to the wall surface of the end of the forward notch or inverse notch.

9. A two-way ratchet screwdriver according to claim 1, wherein, the upper ratchet head has a cylindrical structure, wherein an outer end surface of the upper ratchet head is provided with a circle of wheel facing teeth, and an inner bottom surface of the upper ratchet head is provided with a circle of ratchet teeth.

* * * * *